United States Patent [19]

Kurashima

[11] 4,361,936

[45] Dec. 7, 1982

[54] DECORATIVE CUFFLINK

[76] Inventor: Hideo Kurashima, 2-5-6 Negishi, Taito-ku, Tokyo, Japan

[21] Appl. No.: 282,929

[22] Filed: Jul. 13, 1981

[30] Foreign Application Priority Data

May 19, 1981 [JP] Japan ..... 56-72231[U]

[51] Int. Cl.[3] ..... A44B 5/00

[52] U.S. Cl. ..... 24/41; 24/217 R; 24/218

[58] Field of Search ..... 24/41, 42, 43, 44, 46, 24/217 R, 217 W, 218, 221 R, 221 K

[56] References Cited

U.S. PATENT DOCUMENTS

| | | | |
|---|---|---|---|
| 506,778 | 10/1893 | Gronberg | 24/41 |
| 644,894 | 3/1900 | Carlin | 24/43 |
| 885,419 | 4/1908 | Adams | 24/217 W |
| 908,745 | 1/1909 | Clark | 24/41 |
| 2,745,620 | 5/1956 | Murphy | 24/217 |
| 3,107,409 | 10/1963 | Arthaud et al. | 24/218 |
| 3,220,073 | 11/1965 | Arzt | 24/41 |
| 3,643,296 | 2/1972 | Kahn | 24/217 |
| 3,718,950 | 3/1973 | Engstrom | 24/217 |
| 4,242,776 | 1/1981 | Kurashima | 24/41 |

FOREIGN PATENT DOCUMENTS

| | | | |
|---|---|---|---|
| 551971 | 5/1932 | Fed. Rep. of Germany | 24/41 |
| 533883 | 3/1922 | France | 24/41 |
| 701467 | 3/1931 | France | 24/41 |

*Primary Examiner*—Paul J. Hirsch
*Assistant Examiner*—David L. Tarnoff
*Attorney, Agent, or Firm*—Cushman, Darby & Cushman

[57] ABSTRACT

This invention relates to a cufflink disassemblably coupled of its two pieces, one being a decorative member and another being a keeper element, with the aid of a spring clip.

The above assembling and disassembling are made quite easily and quickly by manual one touch fingering at a desired time, and once attached through button holes of the shirt's cuff which may be either one of double type or convertible type it is designed not to slip-off from the cuff, even when the cufflink brushes against a person and/or an object.

7 Claims, 19 Drawing Figures

DECORATIVE CUFFLINK

BACKGROUND OF THE INVENTION

1. Field of the Invention

This invention relates to an improvement of the cufflink.

2. Description of the Prior Art

The one-piece cuff-link conventionally used includes a decorative element and a link member integrally provided therewith, on which an engaging element displaceable in a right angle with an axial direction is attached. This engaging element is inserted into the button holes of the shirt's cuff, keeping its direction in a straight line, and then it is rotated in a direction at a right angle with the axial direction of the link member, so as to securely attach the cufflink onto the cuff.

The usage of such cufflink has a drawback that the insertion of the link into the button holes provided at a rear portion of the cuff, calls for an inconvenient manipulation since the link has been integral with the decorative member, the link has been easily rotated when it has contacted the wearer's clothing and the other objects, and such facts have caused the prior art cufflink to provide an unsightly appearance and to be subject to dropping-off from the cuff and becoming lost.

When the user has worn a convertible cuff shirt usually used for conventional cufflinks, a button has been located near one of the button holes on each cuff. The conventional cufflink as described above has not been able to hide such buttons and thus an unsightly appearance has been provided.

This inventor has proposed several inventions to overcome such drawbacks relating the cufflink, and has obtained the issued Utility Model Nos. 1253159, 1253166 and 1253167 on Oct. 31, 1978 in Japan.

The inventor has further proposed an improved version of the cufflink and has filed Japanese Utility Model application under Ser. No. 54-49013 on Apr. 13 and also filed its corresponding U.S. patent applications under Ser. No. 66,466 on Aug. 13, 1979. The latter has been issued as U.S. Pat. No. 4,242,776 on Jan. 6, 1981.

This invention is summarized as follows:

The cufflink has two units which are disassemblably assembled to one another through a pair of shirt cuff button holes. For assembly the outer end of the shank is inserted through an opening in the back of the decorative head element, pushed in further to deflect two springs inside the decorative head element and then the decorative head element is let go of, to lock the cufflink in an assembled condition. The shank is unitary with a keeper which has a recess in its inner face, for accepting and hiding from view the shirt button found beside one of the cuff button holes on so called "convertible cuff shirts." For removal, the head and keeper are compressed and then relatively turned 90 degrees angularly of the shank.

SUMMARY OF THE INVENTION

The decorative head element of the cufflink has a hole in the back through which the head of the link shank is to be inserted. As the link shank head is inserted its semi-spherical surfaces engages free ends of a spring clip, temporarily pushing them back of a pair of projections which allows them to spread apart. As the head enters between the free ends, they snap into elongated grooves in opposite sides of the link shank head. Releasing finger pressure on the link shank allows the spring clip to resume a planar state, trapping the free ends in the grooves, between the link shank head and the pair of projections. To disassemble the cuff-link, the shank and decorative head element are squeezed together and turned 90 degrees about the shank axis and released. This action first untraps the free ends of the spring clip, then dumps them out of the grooves and then ejects the link shank head from the decorative head element.

The action of the spring clip is enhanced by providing its bridge with an out-of-plane arcuate central portion. In mounting the spring clip upon the inner face of the rear cover plate of the decorative head element, the arcuate portion is resiliently compressed into the plane of the spring clip by being lodged under an L-shaped bracket. Accordingly, the spring clip is resiliently loaded against the inner face of the rear cover plate.

BRIEF DESCRIPTION OF THE ACCOMPANYING DRAWINGS

DETAILED DESCRIPTION OF THE PREFERRED EMBODIMENTS

Figure 1:
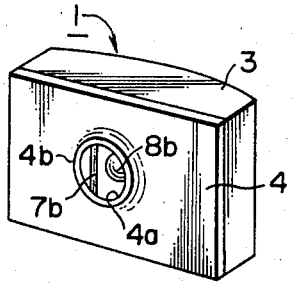
FIG. 1 is a perspective view of the rear side of the decorative head element of the preferred embodiment of this invention.
Figure 4:
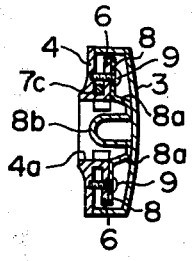
FIG. 4 is a cross sectional view of the decorative head element along line B—B in FIG. 2.
Figure 2:
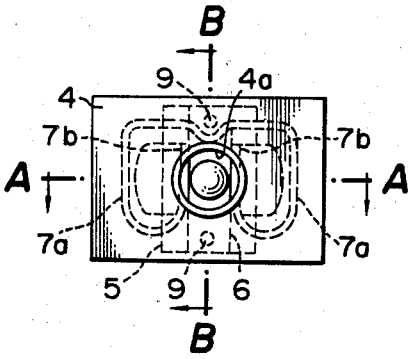
FIG. 2 is a rear side view of the decorative head element.
Figure 5:
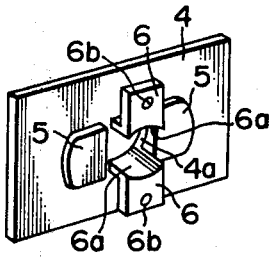
FIG. 5 is a perspective inside view of the rear cover plate of the decorative head element.
Figure 3:
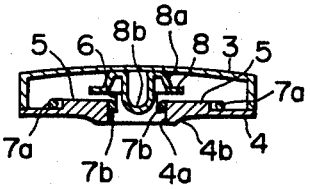
FIG. 3 is a cross sectional view of the decorative head element, along line A—A in FIG. 2.
Figure 6:
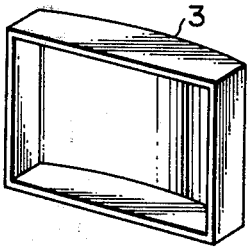
FIG. 6 is a perspective inside view of the case shell of the decorative head element.

In the drawings, there is shown a decorative member 1 which has a casing shell 3, in this embodiment in a generally rectangular box shaped with open back, into which a separate engaging link member shank element 2 is disassemblably attached, so as to form a cufflink.

The casing shell 3 of the decorative member 1 is made of a precious metal or any equivalent material and has a generally rectangular shape with an open back into which a rear cover plate 4 is attached by soldering or any other convenient means. The rear cover plate 4 is formed with a central annular hole *4a* and at its inner surface also has a frusto-conical raised portion *4b* surrounding the outer circumference of said central annular hole *4a*.

Provided on an inside surface of the rear cover plate 4 is a pair of symmetrical wing projections 5 sandwiching said hole *4a*. These projections are generally rectangular with an arcuate tip end and their root portions are disposed near the circumference of the hole *4a*.

Provided on an inner surface of the rear cover plate 4 and in a widthwise direction at the top and the bottom of the hole circumference, sandwiching the hole *4a* are a pair of L-shaped brackets 6,6 of which inner faces are curved partial inner cylindrical or arcuate walls *6a* which continue to the circular hole *4a* and tangs are provided with screw threads holes *6b*. Each width of the L-shaped pieces is so determined to sandwich the spring clip free ends *7b* later discussed, between said wings 5,5 and the brackets 6. A distance between the tang portions of the L-shaped brackets and the inner surface 4 is so determined to sandwich the later discussed spring clip 7.

Figure 7:
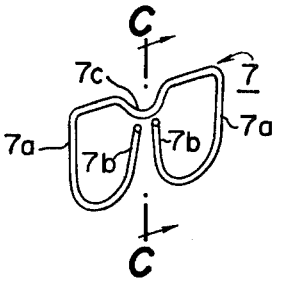
FIG. 7 is a perspective view of the spring clip of the decorative head element.
Figure 8:
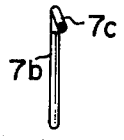
FIG. 8 is a cross sectional view of the spring clip along line C—C in FIG. 7.
Figure 9:
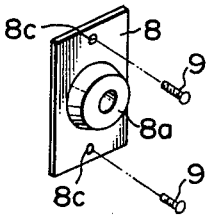
FIG. 9 is a perspective view of the securement plate of the decorative head element.

FIG. 7 shows a convenient spring clip 7 for the present cufflink. This clip 7 has a generally eye-glass frame shape and is made of a resilient material, such as metal wire or any equivalent material. Side legs *7a,7a* are generally symmetrically formed in U-shape and those have free ends *7b* bent inwardly and an upper rim having an arcuate bridge portion *7c* which arches downwardly, and which is also inclined outwardly at an angle to the plane of the remainder of the spring clip. In other words, the plane including said arcuate portion *7c* and the plane containing the frame legs *7a,7a* are not the same plane but angularly intersect as shown in FIG. 8.

This spring clip 7 is at its arcuate bridge portion *7c* inserted within the space between the tang of either one of the L-shape brackets 6 and the rest of the spring clip surrounds the wings 5,5 at its U-shape legs *7a*. Its free ends *7b* are inserted between the wings 5,5 and both sides of the L-shape brackets 6,6 so as to sandwich both ends of the one of the L-shape pieces 6 at its tip ends. Therefore, the free ends *7b,7b* are attached under a stored returning energy to close towards each other.

The slight gap between the tangs of the L-shape brackets 6 and the inner face of the cover plate 4 is wide enough only for accommodating the spring clip diameter. This causes the arcuate portion *7c* to forcibly warp when the dent *7c* is inserted between the selected L-shaped bracket 6 and the rear plate 4, and thus, the side legs *7a,7a* are a force which presses them onto the rear face of the plate 4.

A securing plate 8 is fixed onto the inside the plate 4 after the securement of the spring clip 7. This securing plate 8 is generally formed in a rectangular shape and has toward the casing shell 3 a central frusto-conical projection *8a*, which has a central cylinder *8b* with a semi-spherical tip end oriented toward the rear cover plate 4. The frusto-conical projection *8a* has its root diameter generally identical with the diameter of the annular hole *4a* of the rear back plate 4, and the axes of both the cylinder *8b* and the annular hole *4a* generally coincide. The securement plate 8 has its lengthwise length equal to the horizontal distance between the ends of the L-shaped brackets 6,6 and has its widthwise dimension shorter than said distance. The securement plate 8 is fixed to the plate 4 by inserting screws 9 into the upper and lower holes *8c,8c* in the lengthwise direction and threadably mating said screws 9 within female thread holes *6b,6b*. In a state when the securement plate 8 is fixed, the tip ends of the cylinder *8b* extend to an axial central portion of the annular hole *4a*.

Figure 10:
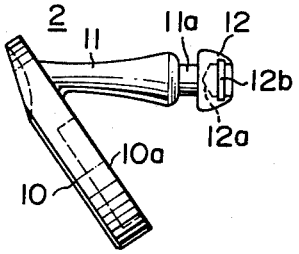
FIG. 10 is a side view of the link shank element.
Figure 12:
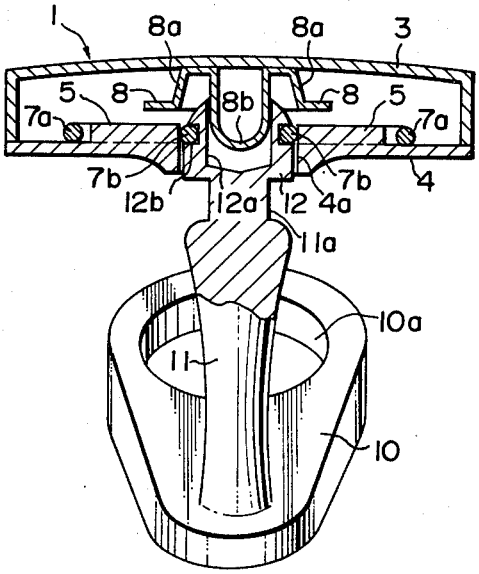
FIG. 12 is a partial transverse cross sectional front view illustrating the engaged or locked condition of the decorative head and link shank elements.
Figure 11:
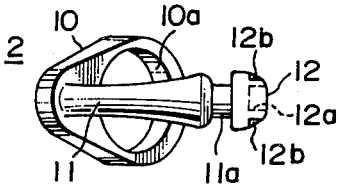
FIG. 11 is a plan view of the link shank element.

The link 2 has a structure as shown in FIGS. 10 and 11, which comprises a keeper 10 having a recess 10*a* for hiding a button in the shirt's sleeve cuff, and a shank 11 integrally provided at one end thereof, extending from its inner side on the same side of the recess 10*a*, at a certain angle forming a generally V-shape therebetween, as shown in FIG. 10.

The shank 11 has at its tip end a semi-spherical head 12 of which the cental forward end has a through hole 12*a* for receiving said cylinder *8b*. Provided at opposite sides sandwiching the hole 12*a*, are grooves or slits 12*b*,12*b* with bottom walls which extend parallel with an axis of the shank 11 and upper and lower side faces which are perpendicular to the axis, thereby providing enough width and depth for receiving the free ends *7b* of the spring clip 7.

The head 12 is formed semi-spherically but its circular curved face continues from a position generally identical with the side rim of the button hiding recess 10 side of said slits 12*b*. The root of the head has a plane surface perpendicular to the axis of the shank 11 and a smaller diameter arm continues therefrom to the shank 11. This arm 11*a* has a smaller diameter than the shank 11 and a length slightly larger than the thickness of the cloth of the sleeve cuff of the shirt.

Now, installation/assembly and removal/disassembly of the cufflink on and from a shirt cuff will be explained in more detail.

First, for wearing, the shank 11 is inserted into the button holes of the cuff and the head 12 is inserted into the circular hole *4a* of the decorative head 1, keeping the slits 12*b*,12*b* of the head 12 opposite to the free ends *7b,7b* of the clip spring 7.

Figure 13:
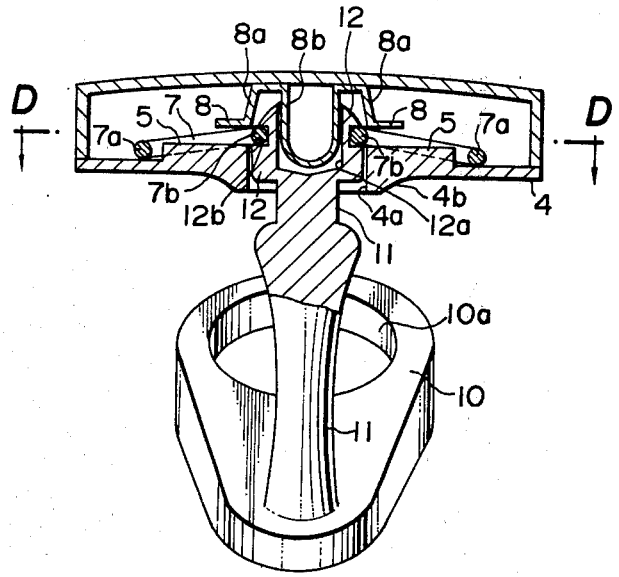
FIG. 13 is a partial transverse cross sectional front view illustrating the beginning of the decoupling of the two elements.
Figure 14:
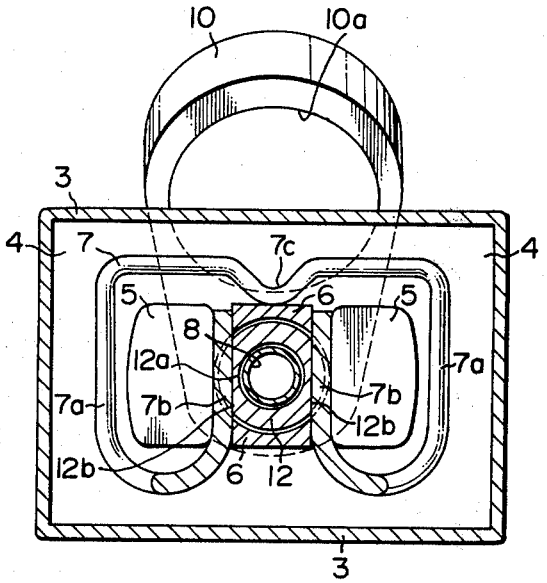
FIG. 14 is a cross sectional view of the decorative head and link shank elements along line D—D in FIG. 13.

The clip's free ends *7b,7b* are forcibly spreaded along the semispherical surface of the head 12 and pushed upwardly, as shown in FIG. 13, and upon oppositely facing the slits 12*b* and the free ends *7b*, the free ends *7b* come into the slits 12*b* by their own stored energy and the cylinder *8b* mates within the through hole 12*a*.

This state is shown in FIG. 13. In this state, a release of a pressure onto the shank 2 pushes back the shank 2, keeping the clip free ends *7b* within the slits 12*b* mated, because of their pressure toward the rear cover plate 4, and then the head 12 returns to its original position of the clip's free ends *7b*, together with said free ends *7b*. In this state, since the free ends *7b* are completely mated within the slits 12*b*, the head is not prevented from returning into the annular hole *4a*, the clip free ends *7b* never slip off nor come out from the slits 12*b* and the shank 2 never slip nor come out from the decorative member 1. This means that the decorative member 1 never rotate nor drop unless it is pushed or compressed toward the shank 2, since the clip free ends 7b are blocked from moving, by the circumferential wall of the annular hole 4a. This locking operation is accomplished by the work of one finger.

Figure 15:
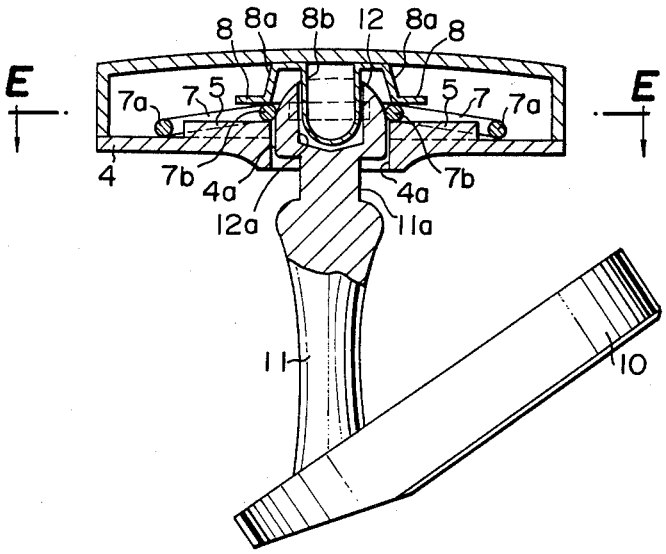
FIG. 15 is a partial transverse cross sectional front view showing a state when the decorative head element is rotated for 90° at the beginning of the decoupling of the decorative head element from the link shank element.
Figure 16:
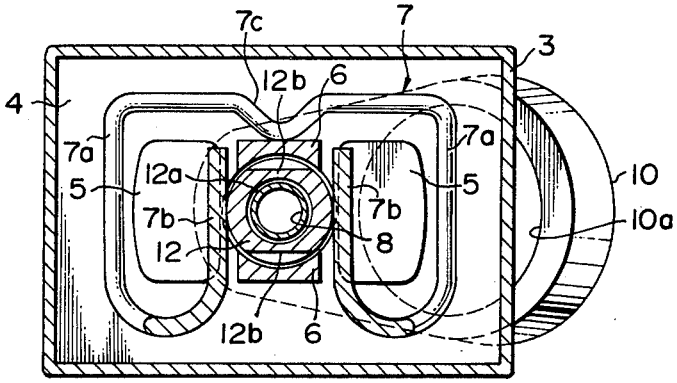
FIG. 16 is a cross sectional view of the two elements along line E—E in FIG. 15.
Figure 17:
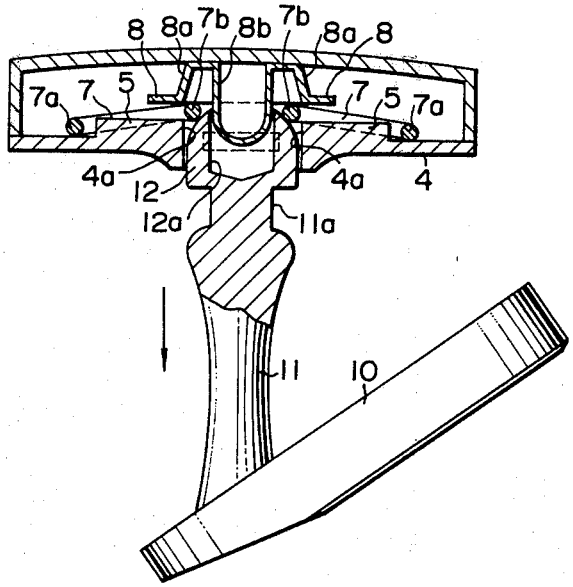
FIG. 17 is a partial transverse cross sectional front view showing a state shortly before the decoupling of the decorative head element from the link shank element.
Figure 18:
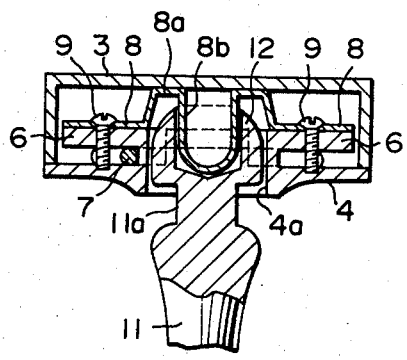
FIG. 18 is a partial transverse cross sectional view showing a relationship between the head of the link shank element and the decorative head element.

For removal of the cufflink, one must push the decorative member 1 toward the shank 2 to push the clip free ends 7b out from the annular hole 4a, and then rotate the head in either direction through 90° with respect to the link 2 from the state shown in FIG. 13 to the state shown in FIG. 15. Then, the clip free ends 7b,7b, respectively come out from the slits 12b,12b and contact the arcuate circumference of the head 12 angularly between the slits 12b,12b.

In this state, the clip free ends 7b,7b have two kinds of stored energy, or attracting energy therebetween and a repelling power to push the link 2 out. Since the head semi-spherical surface 12 starts a position generally identical with the side rim of the button keeper 10 side, the clip free ends 7b slide along the semi-spherical surface 12 of the head and the head 12 is, as a result, pushed out from the annular hole 4a to permit an easy de-coupling of the link 2. After that, the clip free ends 7b,7b take positions between the wings 5 and the L-shaped brackets 6. Thus, the assembling and the disassembling and attaching and detaching of the cufflink is quite easily accomplished at a desired time.

Heretofore, the embodiment has been explained for the usage for the convertible sleeve cuff having a button thereon which is hidden within the recess 10a of the keeper 10, but the cufflink is also compatibly usable with a conventional or double "French" cuff. The decorative head can be decorated with a fanciful design, symbol or symbols or alphabets such as the initials of the wearer's name, a house or family mark or a club's mark and the like. Those can be engraved on the decorative surface or attached with an adhesive-backed metallic sticker having those decorative signs. Those stickers can be selected by the wearer.

Figure 19:
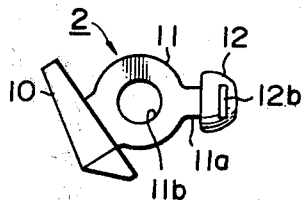
FIG. 19 is a side view showing another embodiment of the link shank element of this invention.

FIG. 19 shows another embodiment in which the shank 11 has a head 12 formed in an annular ring shape having its central hole 11b to prevent the link from rotating but its shape is arbitrarily selective as far as the same function is obtained.

The cufflink according to this invention has a simple design for manufacture but provides an esthetic outside view and a means for attachment and detachment by the work of one finger and it is usable for both convertible and double cuff shirts.

I claim:

1. In a cufflink which is disassemblably assembled of two sub-assembly elements comprising a decorative head element and a link shank element, the improvement wherein:

(a) the decorative head element includes:

(i) a casing shell having a rear cover plate centrally provided with a through hole and an inside face presented towards the interior of the casing shell;

(ii) a spectacles frame-shaped spring clip having a pair of laterally spaced, generally U-shaped legs having respective free end portions nearest one another and having respective opposite ends joined by a rim; said rim, in the vicinity of said free end portions having an arcuate bridge portion; all of said spring clip but for said bridge portion lying generally in a common plane, and said bridge portion extending at an acute angle which intersects said common plane where said bridge portion meets the remainder of said rim;

(iii) said rear cover plate including limited gap bracket means mounting said spring clip by the jamming of said bridge portion into a limited gap provided by said bracket means, this limited gap being able to receive said bridge portion only when said rim is resiliently torsionally stressed by an amount sufficient to cause said bridge portion to lie substantially in said common plane, whereby said spring clip is resiliently loaded against said inside face of said rear cover plate;

(iv) said spring clip free end portions being juxtaposed with said hole for normally blanking-off two diametrically-opposed perimetrical segments of the hole; and (b) the link shank element includes:

(i) a shank having a head end and a keeper end;

(ii) a keeper secured to the keeper end of the shank;

(iii) the head end having a convexly curved head provided with a diametrically opposed pair of grooves which extend angularly of the shank, so that when the head of the link shank element is thrust into the hole in the rear cover plate of the decorative head element, the head first deflects the spring clip legs away from the rear cover plate and their free end portions laterally away from one another, until the free end portions snap into the respective grooves as the torsional stresses in said rim force the spring clip legs back against said inside face of said rear cover plate.

2. The cufflink improvememt of claim 1, wherein:

said inside face of said rear cover plate is provided with a pair of bosses flanking diametrically opposite sides of said through hole; and said inside face of said rear cover plate is provided with a pair of L-shaped brackets flanking diametrically opposite sides of said through hole angularly between said bosses;

each L-shaped bracket having a first leg based on the rear cover plate, with a radially inner side that is cylindrically concavely coincident with a respective portion of the perimeter of the through hole, and a radially outwardly projecting tang;

one of said L-shaped brackets constituting said limited gap bracket means.

3. The cufflink improvement of claim 2, wherein:

each of said U-shaped legs of said spring clip generally encircles a respective said boss, with each free end portion extending laterally between the respective said boss and both of said L-shaped brackets.

4. The cufflink improvement of claim 2, wherein:

there is provided a securement plate mounted on both of said tangs, said securement plate having a central round-tipped cylindrical projection towards and in coaxial alignment with said through hole and an annular well surrounding said projection at the base thereof;

said shank having an axially-opening socket in said head thereof, which socket receives said projection as said head is inserted through said through hole and into said annular well.

5. The cufflink improvement of claim 1, wherein:

said keeper includes means defining a recess which is sized and positioned to hide a shirt cuff button.

6. The cufflink improvement of claim 1, wherein:

said shank includes means defining a circumferentially extending recess just back of said head.

7. The cufflink improvement of claim 1, wherein:

said shank between said head and said keeper is ring-shaped so as to have an opening laterally therethrough.

* * * * *